United States Patent [19]

Kiteck

[11] Patent Number: 4,667,864

[45] Date of Patent: May 26, 1987

[54] LOW NOISE AND HIGH EFFICIENCY DOFFING GUN

[75] Inventor: Paul D. Kiteck, High Point, N.C.

[73] Assignee: Burlington Industries, Inc., Greensboro, N.C.

[21] Appl. No.: 906,906

[22] Filed: Sep. 15, 1986

[51] Int. Cl.[4] ..... B65H 51/16; B65H 54/00

[52] U.S. Cl. ..... 226/97; 28/271; 57/22; 57/305; 226/7; 226/95

[58] Field of Search ..... 226/7, 91, 92, 95, 97; 57/305, 304, 1 R, 333, 22; 28/271–276

[56] References Cited

U.S. PATENT DOCUMENTS

| | | | |
|---|---|---|---|
| 3,144,187 | 8/1964 | Naumann | 226/95 |
| 3,241,234 | 3/1966 | Kiefer et al. | 226/97 X |
| 3,424,359 | 1/1969 | Houle et al. | 226/97 |
| 3,678,579 | 7/1972 | Slavik | 226/97 X |
| 3,679,114 | 7/1972 | Ostertag et al. | 226/97 |
| 3,690,530 | 9/1972 | Porter | 226/97 |
| 4,024,698 | 5/1977 | Weiss et al. | 57/305 |
| 4,030,651 | 6/1977 | Weiss et al. | 226/97 |
| 4,110,876 | 9/1978 | Weiss et al. | 226/97 X |
| 4,114,790 | 9/1978 | Sighieri et al. | 226/91 |

*Primary Examiner*—John Petrakes

*Attorney, Agent, or Firm*—Nixon & Vanderhye

[57] ABSTRACT

A doffing gun for aspirating yarn includes a vacuum chamber tube threadably connected to an ejector handle body formed with a first bore axially aligned with the vacuum chamber and a second bore substantially perpendicular to the first bore. The first bore includes a mixing chamber into which air under pressure is admitted through the second bore and a third bore which extends between the first and second bores. The third bore is oriented so that it enters the mixing chamber at an angle of about 15° to 30° from the longitudinal axis of the vacuum chamber tube and axially aligned first bore. Attached to the outlet or exhaust end of the ejector handle is a noise reduction means which, in turn, is connected to a diffusing nozzle and collection bag. The collection bag comprises upper and lower sections of tightly woven and open mesh materials, respectively.

34 Claims, 8 Drawing Figures

LOW NOISE AND HIGH EFFICIENCY DOFFING GUN

BACKGROUND OF THE INVENTION

Doffing guns are typically used in the texturing areas of textile facilities to doff yarn when threading up the texturing machines. In a typical doffing gun, a thread is sucked through the inlet suction tube and discharged out the exhaust side through a diffuser cone into a yarn collecting sack. Suction in the gun is generated by a draft tube ejector whereby compressed high-velocity air enters through the gun handle and mixes with the secondary, low-velocity fluid present in the ejector. Through this mixing or aspirating, a major portion of the momentum of the primary fluid is imparted to the secondary fluid, resulting in an air vacuum.

Doffing guns present in the prior art typically have high noise levels associated therewith. For example, two known, commercially available doffing guns built by American Barmag Co. (Barmag) and Maybry Industries of North Carolina, as well as an in-house unit of Burlington-Madison Yarn Company (BMYC) all have noise levels significantly higher than a sound specification for auxiliary sound sources. In addition, they often have inefficient vacuums, which require significant amounts of compressed air. Because the doffing unit must be capable of removing yarn at a speed equal to or greater than the machine yarn speed, the amount of air suction is very important for overall performance.

SUMMARY OF THE INVENTION

The object of this invention is to provide an efficient doffing gun while maintaining low noise levels and acceptable performance. It is further an object of this invention to provide a doffing gun which is durable and user oriented. As is the case of the typical prior art doffing guns, the present invention includes a vacuum chamber tube connected to an ejector handle which provides an inlet for compressed air and a mixing chamber which creates suction in the vacuum chamber tube. In the present invention, however, the compressed air flows into the mixing chamber at a specified angle which can vary between 15° and 30° from the center line axis of the vacuum chamber tube and axially aligned through passage in the ejector handle.

The present invention also employs an aspirator-type muffler connected to the rearward end of the ejector handle. At the other end of the muffler there is connected a diffusing nozzle designed to reduce air exhaust noise and to diffuse a proportion of the air exhaust. The unique design of the diffusing nozzle enables it to further function as a bag retention means for holding a collection bag which collects the exhausted yarn waste. The collection bag is also used to disperse the exhaust air flow and to reduce air exhaust noise.

A thorough understanding of the invention may be obtained with reference to the detailed description of the invention and claims which follow.

DETAILED DESCRIPTION OF THE DRAWINGS

Figure 1:
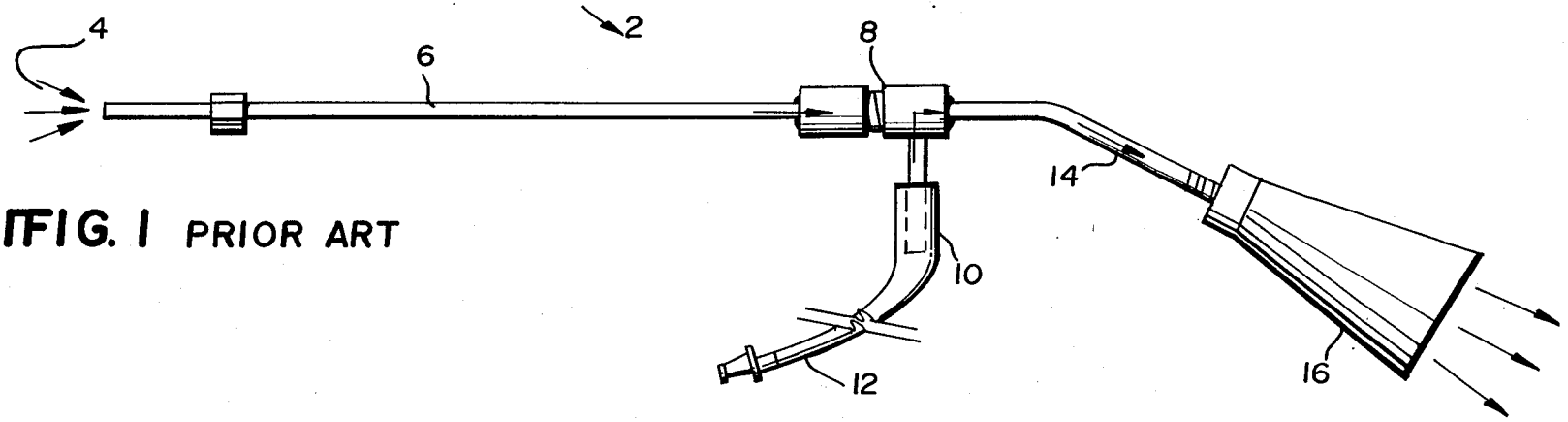
FIG. 1 PRIOR ART
FIG. 1 illustrates a typical prior art doffing gun.

With reference to FIG. 1, there is shown a typical prior art doffing gun 2. Generally, such doffing guns include a vacuum chamber tube 6 which defines a suction inlet 4 at one end, and which is connected to an ejector handle 8 at its other end. The ejector handle 8 is provided with a compressed air intake 10 to which is connected a tube 12 from a compressed air source (not shown). An air exhaust pipe 14 is connected at the rearward end of the ejector handle 8 and directs exhaust air into a diffuser cone 16 which is connected to a collection bag (not shown). The in-flow of compressed air into the ejector handle portion of the gun aspirates ambient air through the inlet 6 so that a yarn may be drawn by suction into the ejector handle in a manner well understood by those of ordinary skill in the art.

Typical air suction values for acceptable operation on high speed machines are 10–18 inches Hg, using a compressed air input of 80–90 psi. The amount of tension or pull on the yarn as it enters the mixing chamber is important for satisfactory operation. For example, the minimum value of tension on a 140 denier yarn is approximately 20 grams. For larger yarn denier, such as 3000 denier, the tension required is greater than 95 grams. The doffing gun of this invention is capable of providing a tension of 22 grams on 140 denier yarn and 130 grams on 3000 denier (2-ply) yarn.

Figure 2:
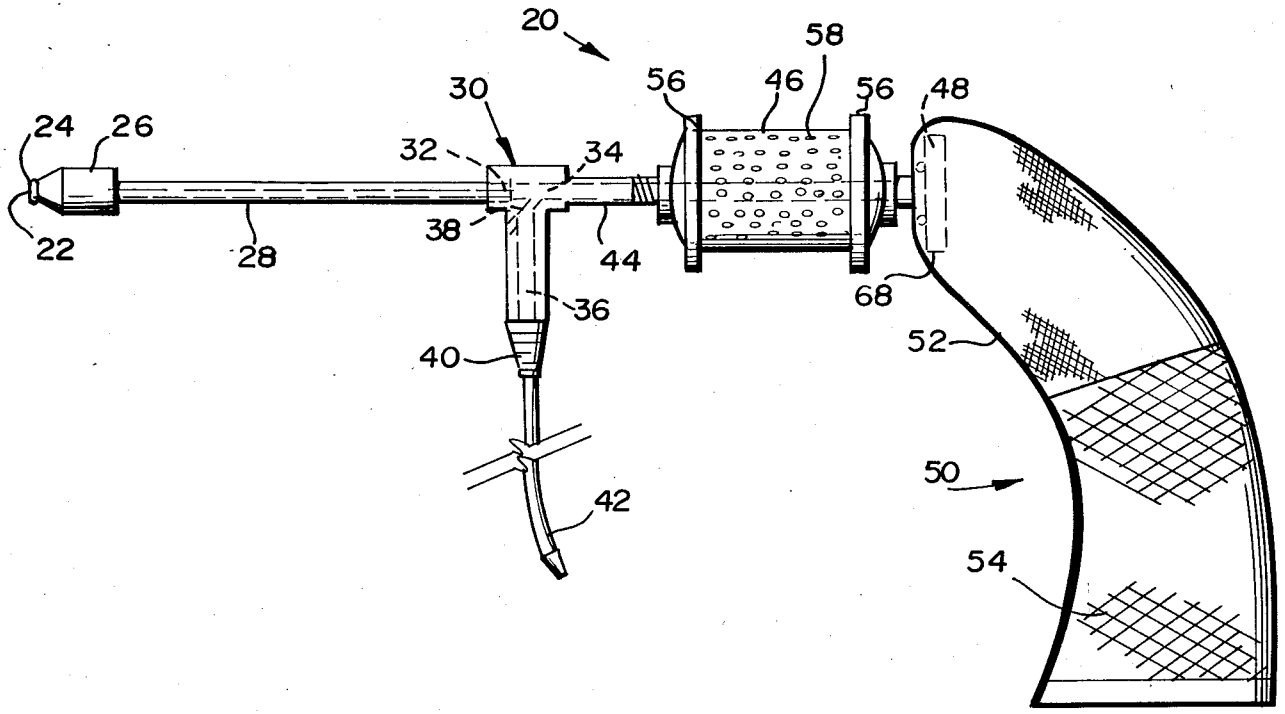
FIG. 2 illustrates an exemplary embodiment of a doffing gun of this invention.

Referring now to FIG. 2, a new doffing gun in accordance with an exemplary embodiment of this invention is shown. The gun 20 includes a vacuum inlet 22 provided with a ceramic insert 24. The insert serves to eliminate abrasion of the tip by the doffed yarn and provides approximately 2 to 3 dB(A) of noise reduction. There is also provided a counterweight 26 at the suction inlet to balance the hand-held doffing gun.

Figure 3:
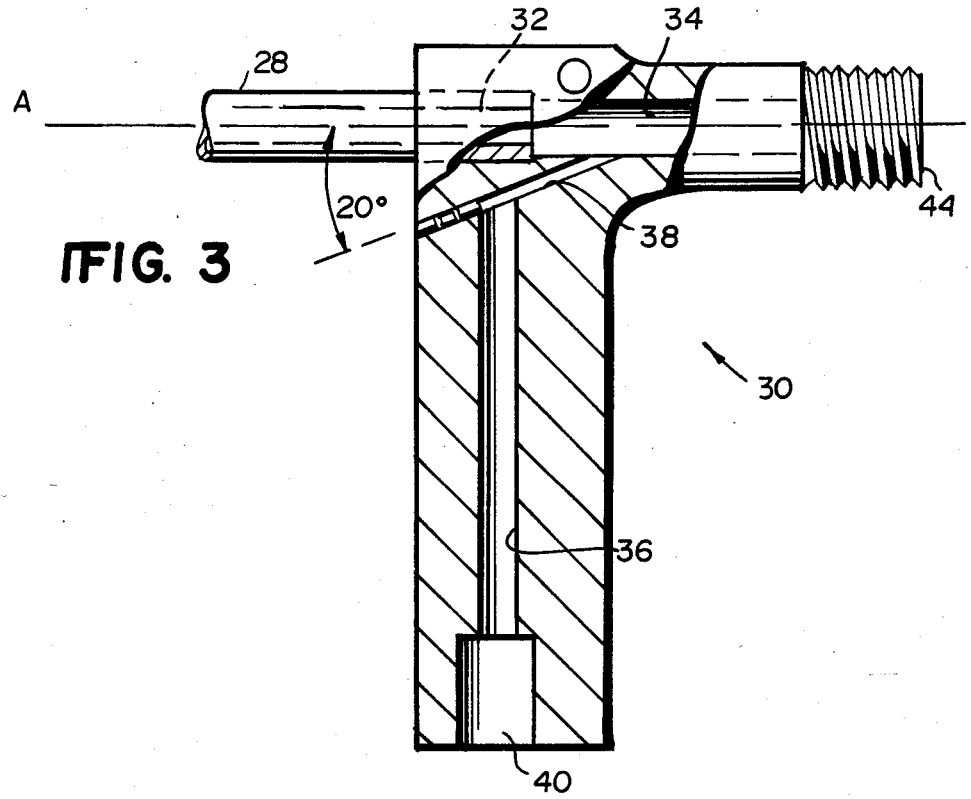
FIG. 3 is a detailed view of the ejector handle illustrated in FIG. 2.

The vacuum chamber tube 28 is connected to an ejector handle body 30, preferably by a threaded connection at 32. The ejector handle body 30, which is more clearly shown in FIG. 3, is provided with a first, annular through passage, a portion of which defines a mixing chamber 34 which is axially aligned with the vacuum chamber tube 28. The ejector handle body is further provided with a second passage 36 generally perpendicular to the first passage 34 for supplying compressed air to the mixing chamber 34. The first and second passages 34, 36 are connected by a smaller diameter angled bore 38. The angle of entrance of this connecting bore into the first passage, mixing chamber, 34 can vary between about 15° and 30° from the center line axis A of the vacuum tube 28 and ejector handle first passage 34. The angle utilized in the preferred embodiment illustrated in FIG. 3 is about 20°. The diameter of the angled bore 38 determines the amount of vacuum and the air exhaust noise, i.e., exhaust noise increases proportionally to increases in the angled bore diameter. The required diameter of this portion ranges from about 0.125 inch to a maximum of approximately 0.22 inch. A preferred diameter of about 0.156 inch provides satisfactory vacuum while minimizing exhaust noise. During manufacture, the angle bore 38 may be formed by, for example, drilling the bore from one side of the ejector handle and, thereafter, closing the unused portion of the bore with a plug 39.

The ratio of the diameters of the vacuum chamber tube 28 and the ejector handle first through passage or mixing chamber 34 is important for establishing maximum efficiency of the unit. In the preferred embodiment, the diameter of the first through passage or mixing chamber 34 is about 0.375 inch while the diameter of the vacuum chamber tube 28 is about 0.25 inch.

The second passage 36 in the ejector handle body 30 is provided with a compressed air inlet 40 which, in turn, is connected to a tube 42 from a compressed air source (not shown).

The air-exhaust flow of the ejector handle doffing guns in through the throat, which typically has an internal diameter of about 0.25 to 0.50 inch, preferably about 0.375 inch. The high speed and/or unsteady air-exhaust flow through the throat produces high aerodynamic noise associated with the turbulent mixing of the air stream and the medium into which it flows. Accordingly, the threaded exhaust throat 44 of this invention is connected to an aspirator type muffler 46 which thread or other material can pass through without interference or hang-ups.

Figure 5:
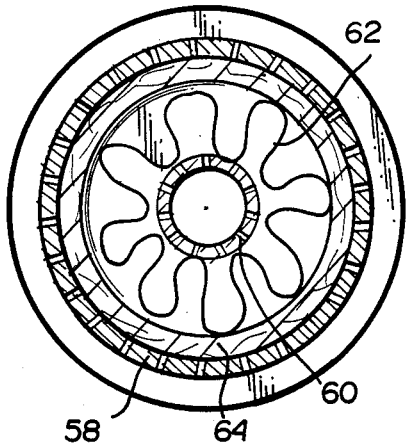
FIGS. 4 and 5 are detailed views of the muffler employed in the doffing gun illustrated in FIG. 2.
Figure 4:
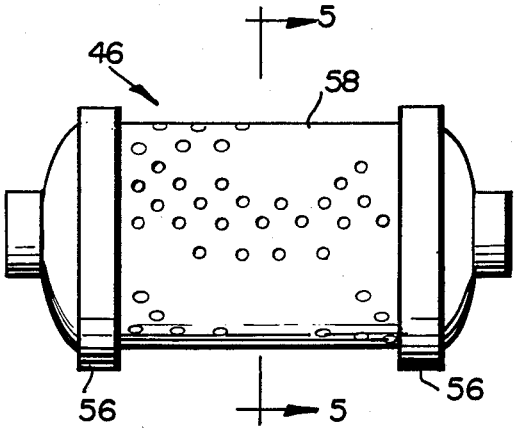

The muffler 46, which is shown in greater detail in FIGS. 4 and 5, consists of annular end pieces 56 which enclose a perforated cylindrical 58. An inner perforated tube 60 is surrounded by a layer of polyester foam or felt 62, which is preferably about 0.5 inch to about 0.75 inch thick. Interposed between the foam layer and the outer perforated shell 58 is phenyl fiber layer 64 composed of inert glass fibers firmly bonded in a random lattice, approximately ⅛ inch thick. The construction of this layer is such that the phenyl fiber material does not shed fibers because of a thermal setting phenolic resin binder. The preferred muffler is one which is manufactured by the Allied-Witan Company of Cleveland, Ohio (Model No. A-05). In the doffing gun of this invention, the muffler provides approximately 12 to 14 dB(A) of noise reduction.

Figure 6:
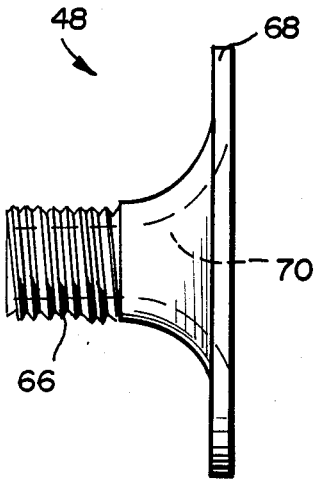
FIGS. 6 and 7 are detailed side and front views of the diffuser nozzle illustrated in FIG. 2.
Figure 7:
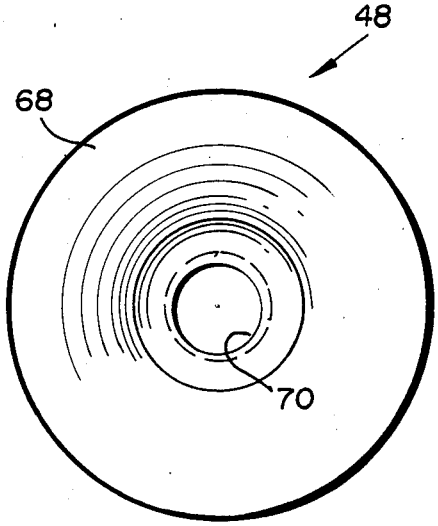

At its rearward end, the muffler is threadably secured to a diffusing nozzle 48, the details of which are shown more clearly in FIGS. 6 and 7. The diffusing nozzle is provided with a threaded end portion 66 for connection to the rearward end of the muffler, and a flared second end terminating in an annular flange 68 which serves as a retaining means for the collection bag 50. The diffusing nozzle is provided with a nozzle portion 70 flared outwardly in the direction of air flow. While the diffuser cone 16 of the prior art doffing gun was found to add approximately 4.0 dB(A) of noise to the overall noise level of the unit, the diffuser nozzle of this invention is designed specifically to reduce the air exhaust noise.

Referring again to FIG. 2, the collection bag 50 attached to the annular flange 68 of the diffuser nozzle 48 serves to collect the exhausted yarn waste, but is also used to disperse the exhaust air flow and to reduce air exhaust noise. The collection bag is constructed of a tightly woven material for the top half 52 and of an open mesh knit material for the bottom half 54. The upper half 52 directs the flow toward the bottom, preventing the rear air flow from disturbing a krill yarn usually located directly behind the doffing gun operator. The bottom half 54 provides a clear view of the yarn waste as well as an outlet for air exhaust.

The woven section 52 of the bag can be a durable fabric made of cotton, polyester/cotton or other appropriate fibers. Virtually any weave, including plain, twill, sateen, etc., would be appropriate. The preferable air porosity range is 20 to 50 cubic feet per minute per square foot (at 0.5 inch water pressure drop) or less. The preferred bag is 100% cotton, 2 by 1 twill, with a construction of 86 ends by 44 picks, having a porosity of 35 to 40 cubic feet per minute per square foot. The open mesh portion 54 of the bag is preferably made of a continuous filament yarn of nylon, polyester or polypropylene. The diameter of the mesh openings in the fabric should be in the range of approximately 0.03 to 0.08 inch. The knit should be constructed of approximately 8–14 wales per inch and 16 to 20 courses per inch with a porosity of 1,000 cubic feet per minute per square foot or greater. The preferred bag is knit of a continuous filament yarn in a warp knit mesh using 2 or 3 partially threaded guide bars. The knit is constructed of 10–12 wales by 16–18 courses per inch, with a pore opening size of approximately 0.04–0.06 inch and an air porosity of 2,000 to 3,000 cubic feet per minute per square foot.

Figure 8:
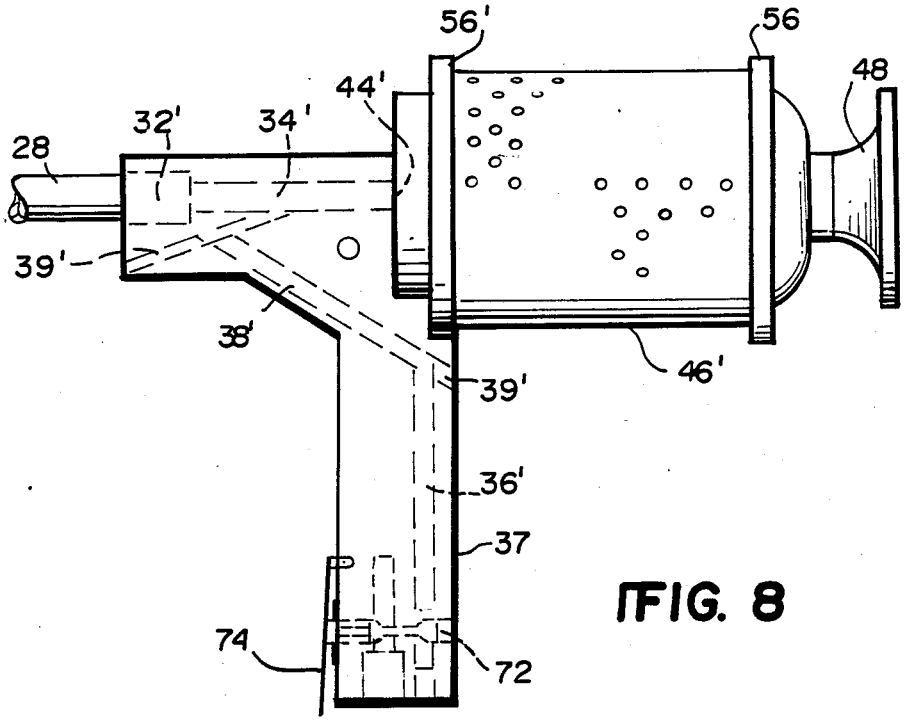
FIG. 8 illustrates an alternative embodiment of the ejector handle shown in FIG. 3.

In FIG. 8, there is shown an alternative embodiment of the handle ejector 30 shown in FIG. 3. In the alternative construction, the handle ejector body 30' has been altered to permit the muffler 46' to be located directly adjacent the depending handle portion 37, with the forward end of the muffler connected at throat 44' substantially directly above the second bore 36', so as to provide better weight distribution and balance, and to eliminate the need for any counterweight, such as that shown at 26 in FIG. 2.

Because of this construction, a double-angled third bore 38' is required for connecting passage 36' to the mixing chamber 34'. It is apparent that for this embodiment, two angled bores must be drilled into the body 30', with plugs 39' being used to close the additional unneeded bore sections. Entrance of double-angled third bore 38' into the mixing chamber 34' is between about 15° and 30° from the longitudinal axis of the vacuum chamber tube, and preferably about 20°, as shown in the FIG. 3 embodiment.

FIG. 8 also illustrates the use of an air control valve 72 for regulating the in-flow of compressed air, as well as an on/off control 74 for the valve. It is understood that the valve 72 may be of any conventional type, the selection of which is well within the skill of the art.

The exemplary embodiment of the doffing gun disclosed herein operates at a noise level of approximately 84 dB(A). This represents a 22 dB(A) reduction in the overall noise level compared to typical BMYC doffing guns currently in use.

In addition, the doffing gun of this invention uses approximately 38% less air than the BMYC gun, resulting in substantial operating cost benefit.

It is understood that various changes and alterations can be made to the specifically described embodiments of the invention without departing from the spirit and scope of the claims which follow.

What is claimed:

1. A doffing gun for aspirating yarn comprising:

(a) an ejector handle body having forward and rearward ends and formed with a first through bore extending along a longitudinal axis, a portion of said bore defining a mixing chamber, a second bore extending in a direction substantially perpendicular to said mixing chamber, and adapted to be connected to a source of air under pressure, and a third bore interconnecting the mixing chamber and said second bore, the third bore entering the mixing chamber at an angle of between 15° and 30° from said longitudinal axis, said rearward end of said ejector handle body terminating in an exhaust throat having a diameter equal to that of said mixing chamber;

(b) a vacuum chamber tube having a suction inlet at a forward free end thereof, and connected at a rearward end to said mixing chamber at the forward end of said ejector handle body, upstream of said draft tube, so that air under pressure delivered to said mixing chamber through said second and third bores establishes suction in said vacuum chamber tube;

(c) noise reduction means connected at an inlet end to the rearward end of said ejector handle body and provided with a tubular passageway axially aligned with said first through bore; and (d) exhaust air diffuser means operatively connected to an outlet end of said noise reduction means.

2. A doffing gun as defined in claim 1, wherein said third bore extending between the mixing chamber and second bore of the ejector handle body has a diameter less than the diameter of the mixing chamber.

3. A doffing gun as defined in claim 2, wherein the diameter of said third bore is between about 0.125 and 0.22 inch.

4. A doffing gun as defined in claim 3, wherein the diameter of said third bore is about 0.156 inch.

5. A doffing gun as defined in claim 4, wherein said mixing chamber and said exhauet throat have a diameter of about 0.375 inch and said vacuum chamber tube has a diameter of about 0.25 inch.

6. A doffing gun as defined in claim 3, wherein said third bore enters said mixing chamber at an angle of about 20°.

7. A doffing gun as defined in claim 1, wherein said exhaust air diffuser means comprises an outwardly flared nozzle portion terminating in a radially outwardly directed annular flange.

8. A doffing gun as defined in claim 7, wherein the gun further comprises a collection bag attached to said radially outwardly directed annular flange of said exhaust air diffuser means.

9. A doffing gun as defined in claim 8, wherein said collection bag has an upper portion and a lower portion, said upper portion constructed of a tightly woven material, and said lower portion constructed of an open mesh knit material.

10. A doffing gun as defined in claim 9, wherein the tightly woven material has a porosity of 20–50 CFM/sq.ft.

11. A doffing gun as defined in claim 10, wherein the tightly woven material is cotton and has a porosity of 35–40 CFM/sq.ft.

12. A doffing gun as defined in claim 10, wherein the open mesh material has a porosity of 1000–3000 CFM/sq.ft.

13. A doffing gun as defined in claim 12, wherein the open mesh material is selected from the group consisting of nylon, polyester and polypropylene.

14. A doffing gun as defined in claim 1, wherein said vacuum chamber tube is provided with a ceramic insert at the suction inlet thereof.

15. A doffing gun as defined in claim 1, wherein the noise reduction means comprises a muffler having an outer perforated shell and an inner perforated flow-through tube, and layers of foam and phyenyl fiber material filling the annular space between said shell and said flow-through tube.

16. A doffing gun as defined in claim 1, wherein said third bore enters said mixing chamber at an angle of about 20°.

17. A doffing gun for aspirating yarn comprising:

(a) an ejector handle bcdy having forward ends, formed with a first bore extending along a longitudinal axis to define a mixing chamber, a second bore extending away from and substantially perpendicular to said mixing chamber, and a third bore interconnecting said second bore and said mixing chamber; said rearward end of said ejector handle terminating in an exhaust throat;

(b) a vacuum chamber tube having an inlet at one end and connected at its other end to said ejector handle body mixing chamber;

(c) noise reduction means connected at an inlet end to the rearward end of said ejector handle body in axial alignment with said mixing chamber;

(d) exhaust air diffuser means connected to an outlet end of said noise reduction means, and comprising an outwardly flared nozzle portion terminating in a radially outwardly directed annular flange; and (e) a collection bag attached to said radially outwardly directed flange of said air exhaust diffuser means.

18. A doffing gun as defined in claim 17, wherein said collection bag has an upper portion and a lower portion, said upper portion constructed of a tightly woven material, and said lower portion constructed of an open mesh knit material.

19. A doffing gun as defined in claim 18, wherein the tightly woven material has a porosity of 20–50 CFM/sq.ft.

20. A doffing gun as defined in claim 19, wherein the tightly woven material is cotton and has a porosity of 35–40 CFM/sq.ft.

21. A doffing gun as defined in claim 19, wherein the open mesh material has a porosity of 1000–3000 CFM/sq.ft.

22. A doffing gun as defined in claim 21, wherein the open mesh material is selected from the group consisting of nylon, polyester and polypropylene.

23. A doffing gun as defined in claim 18, wherein said third bore extending between the mixing chamber and second bore of the ejector handle body has a diameter less than the diameter of the mixing chamber.

24. A doffing gun as defined in claim 23, wherein the diameter of said third bore is between about 0.125 and 0.22 inch.

25. A doffing gun as defined in claim 24, wherein the diameter of said third bore is about 0.156 inch.

26. A doffing gun as defined in claim 25, wherein said mixing chamber and said exhaust throat have a diameter of about 0.375 inch and said vacuum chamber tube has a diameter of about 0.25 inch.

27. A doffing gun as defined in claim 24, wherein said third bore enters the mixing chamber at an angle of between about 15° and 30° from said longitudinal axis.

28. A doffing gun as defined in claim 24, wherein said third bore enters said mixing chamber at an angle of about 20°.

29. A doffing gun as defined in claim 1, wherein said inlet end of said noise reduction means is located substantially directly above said second bore.

30. A doffing gun as defined in claim 29, wherein said third bore comprises two sections which intersect at an acute angle.

31. A doffing gun as defined in claim 29, wherein means are provided in said ejector handle body for controlling the flow of air into said second bore.

32. A doffing gun as defined in claim 17, wherein said inlet end of said noise reduction means is located substantially directly above said second bore.

33. A doffing gun as defined in claim 32, wherein said third bore comprises two sections which intersect at an acute angle.

34. A doffing gun as defined in claim 1, wherein means are provided in said ejector handle body for controlling the flow of air into said second bore.

* * * * *

UNITED STATES PATENT AND TRADEMARK OFFICE

CERTIFICATE OF CORRECTION

PATENT NO. : 4,667,864

DATED : May 26, 1987

INVENTOR(S) : Kiteck

It is certified that error appears in the above-identified patent and that said Letters Patent is hereby corrected as shown below:

Column 3, line 32, "phenyl" should read --phenol--; line 32 through line 37, delete "composed of inert glass fibers firmly bonded in a random lattice, approximately 1/8 inch thick. The construction of this layer is such that the phenyl fiber material does not shed fibers because of a thermal setting phenolic resin binder"; line 65, "krill" should read --creel--. Column 5, line 32, "exhauet" should read --exhaust--. Column 6, line 1, "phyenyl" should read --phenol--.

Signed and Sealed this

Thirteenth Day of October, 1987

*Attest:*

DONALD J. QUIGG

*Attesting Officer*

*Commissioner of Patents and Trademarks*